United States Patent [19]

Hancock

[11] Patent Number: 5,076,031

[45] Date of Patent: Dec. 31, 1991

[54] ARENA STRUCTURE

[75] Inventor: Dennis M. Hancock, Birmingham, England

[73] Assignee: Mobile Entertainment Centres Ltd., Birmingham, England

[21] Appl. No.: 600,754

[22] Filed: Oct. 19, 1990

[30] Foreign Application Priority Data

Oct. 28, 1989 [GB] United Kingdom ..... 8924344

[51] Int. Cl.[5] ..... E04H 15/34

[52] U.S. Cl. ..... 52/63; 52/6; 135/101

[58] Field of Search ..... 272/3, 4, 5; 52/6, 63; 135/DIG. 5, 97, 101, 105

[56] References Cited

U.S. PATENT DOCUMENTS 2,440,557 4/1948 Power ..... 135/105
2,903,238 7/1980 Stromeyer ..... 135/97
4,593,710 6/1986 Stafford et al. ..... 52/63
4,880,024 11/1989 Brell ..... 135/DIG. 5

*Primary Examiner*—Richard E. Chilcot, Jr.
*Assistant Examiner*—Wyhh E. Wood
*Attorney, Agent, or Firm*—Bell, Seltzer, Park & Gibson

[57] ABSTRACT

A covered arena structure capable of being erected or dismantled for transport from site-to-site comprises an interior portal frame structure comprising a series of inwardly inclined side members supporting an interior roof structure around the periphery thereof so as to define a substantially unobstructed arena area; a weatherproof membrane covering the interior portal frame structure and being draped over the inwardly inclined side members; an exterior pyramidal frame structure outside the membrane; and suspension means connected between the pyramidal structure and the membrane so as to suspend a portion of the membrane located above the interior roof structure.

11 Claims, 9 Drawing Sheets

ARENA STRUCTURE

The present invention relates to a covered arena structure capable of being erected and dismantled and transported from location to location.

A major problem facing the entertainment industry is the lack of suitable large indoor venues capable of housing concerts and exhibitions, particularly outside the major cities. In many cases, entertainments events only become viable when large numbers of people are able to attend. Thus, there is a need for venues capable of catering for up to 5,000 and even 10,000 people. The provision of suitable sites on a permanent basis often cannot be financially justified. There is therefore a growing need for mobile arena structures capable of accommodating large numbers of people, and yet which can be erected and dismantled for transportation to a new location.

Conventional tents, for example for circuses, do not necessarily fulfil present day requirements. Modern entertainment venues generally have a requirement for substantially unobstructed space, with the absence of supporting poles and pillars which can obstruct people's views and cause problems in maneuvering trucks and other large structures. Furthermore, modern pop concerts generally require a large amount of sound and visual equipment to be suspended from the roof, so that roof structures capable of handling such loads are needed.

It is an object of the present invention to accommodate at least some of these needs.

The present invention provides a covered arena structure capable of being erected and dismantled, and transported from location to location, which comprises an interior portal frame structure comprising a series of inwardly inclined side members supporting an interior roof structure around the periphery thereof so as to define a substantially unobstructed arena area;

a weatherproof membrane covering the interior portal frame structure and being draped over the inwardly inclined side members;

an exterior pyramidal frame structure outside the membrane; and suspension means connected between the pyramidal structure and the membrane so as to suspend a portion of the membrane located above the interior roof structure.

The interior portal frame structure and the exterior pyramidal frame structure are generally composed of standardised lengths of interconnectable girder sections. For strength and lightness, each girder section is generally formed of trusses comprising three or four interbraced metal tubes of steel or aluminium. The portal frame structure is supported around its periphery by the inwardly inclined side members so that the interior space defined thereby is substantially unobstructed. Obviously, members may be positioned within the interior space as desired but these will not be necessary for the structural integrity of the overall arena structure. Generally, the interior roof structure is formed of a grid of interconnected girders which are capable of supporting substantial loads, such as audio equipment, visual equipment, lighting, offices and exhibition structures. Generally, an upstanding wall will be provided around the base of the interior portal frame structure in the angle between the inclined side members and the ground. A dismantable modular floor structure will usually be provided within the wall.

The weatherproof membrane will generally be one or more layers of a waterproof fabric material. A lead-carbon membrane may also be fitted so as to give improved sound insulation. The weatherproof membrane may be provided in a single piece. However, for ease of assembly, the membrane will normally be in the form of a number of separate pieces which may be joined together along their edges. The apex of the weatherproof membrane is suspended from the exterior pyramidal frame structure and is draped over the sides of the portal frame structure, so as to produce a generally pyramidal or conical roof from which any rain drains away.

The exterior pyramidal frame structure is self supporting and usually comprises three or four members meeting at an apex from which the membrane is suspended. Depending on the required size of the arena structure, there may be one or more pyramidal frame structures.

The covered arena structure is arranged to be easily dismantled. Moreover, the size of the arena may be varied to meet particular requirements. Whilst the arena structure is primarily intended to be used on a temporary basis, it may also be used on a more permanent basis in conjunction with existing fixed facilities, such as parking areas, gates. entrances etc. The arena structure can be used to house a wide variety of events in the leisure industry (e.g. concerts, sporting events and fairs), the exhibition and conference industries, the industrial sector (to provide temporary storage and warehousing space), the construction industry (to store equipment, house workshops and cover building sites), to provide temporary prison and military accommodation, and for use in the film and video industry. A particular benefit of a transportable arena structure is that it is not necessary to tailor the event to each individual venue.

An embodiment of the present invention will now be described by way of example only with reference to the accompanying drawings wherein.

Figure 1:
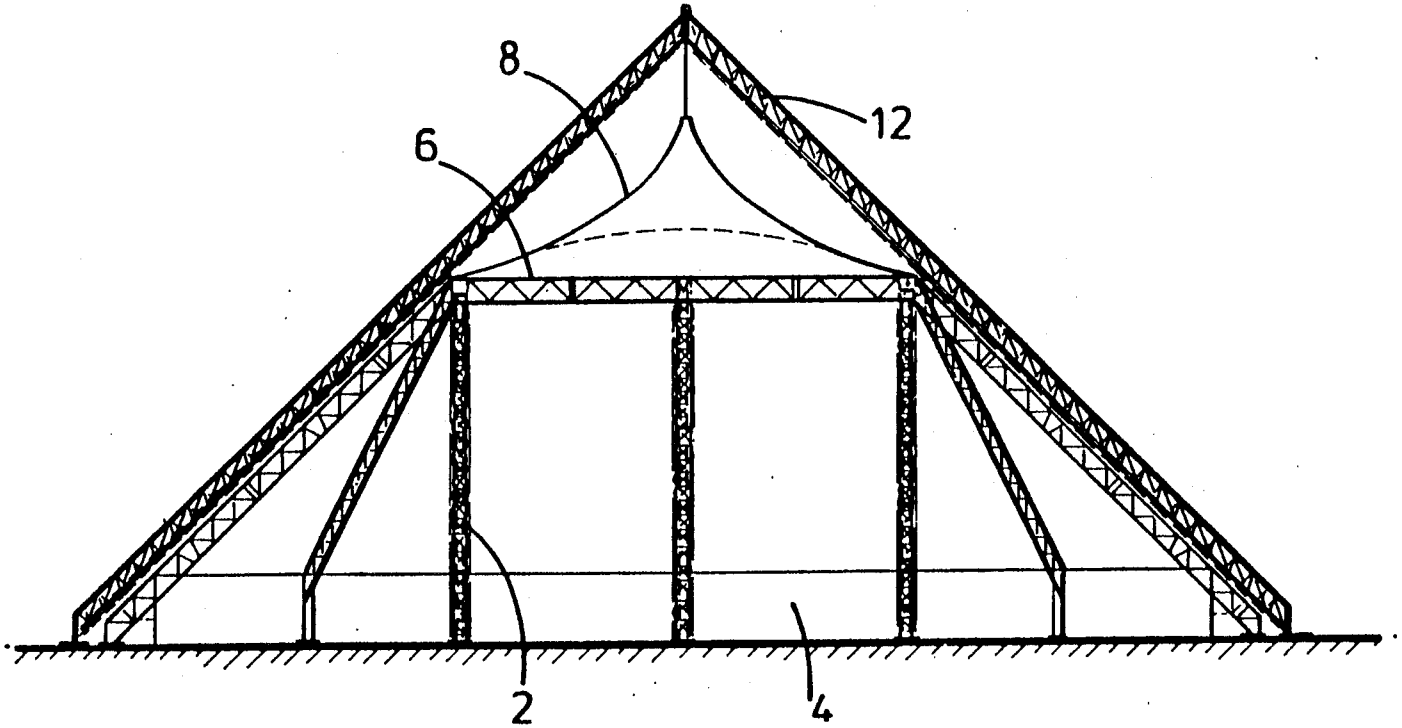
FIG. 1 is a cross sectional end view of an arena structure.
Figure 2:
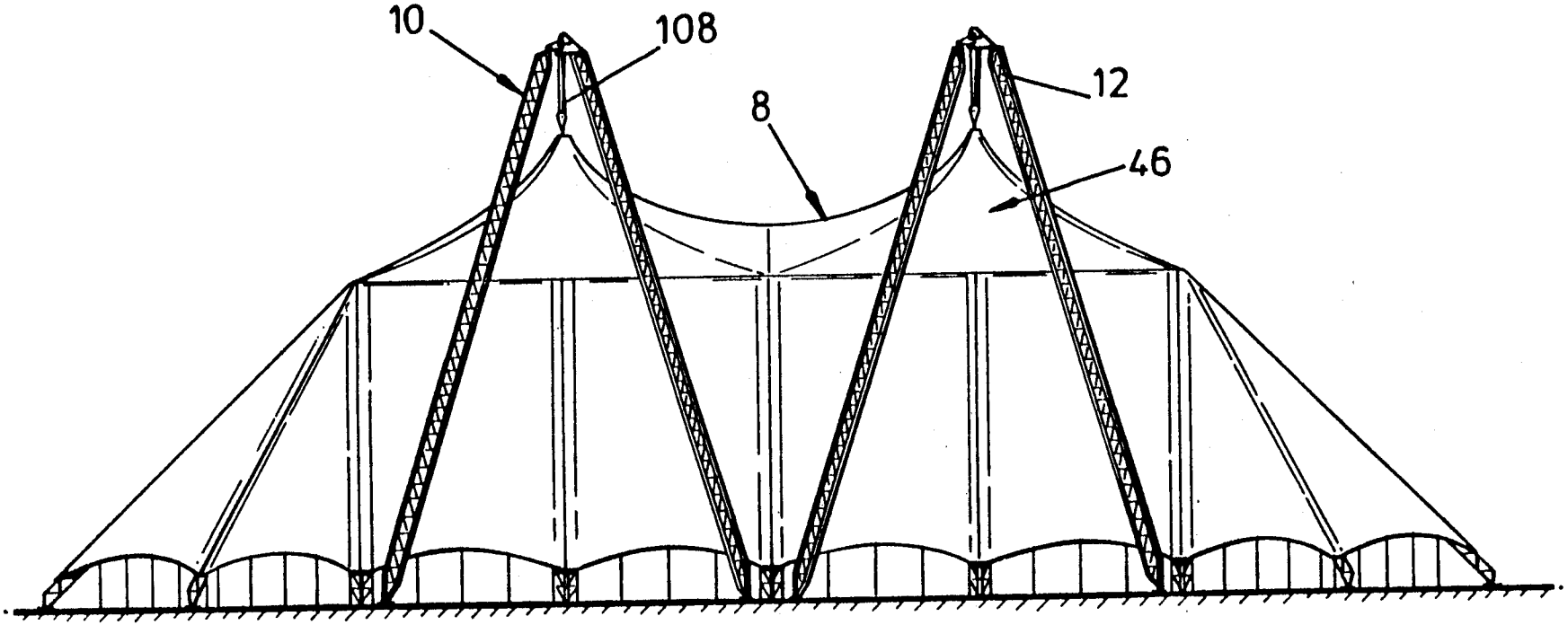
FIG. 2 is a side elevation.

As particularly shown in FIGS. 1 and 2, the arena structure comprises an interior portal frame structure 2 having an interior wall 4 and a roof structure grid 6. A multi-piece weatherproof membrane 8 is suspended over the portal frame structure by means of a pair of pyramidal frame structures 10,12. Membrane 8 can incorporate a lead-carbon layer between two sound attenuation outer membrane layers. A demountable floor structure (not shown) is usually provided within the area bounded by the interior wall 4.

Figure 3:
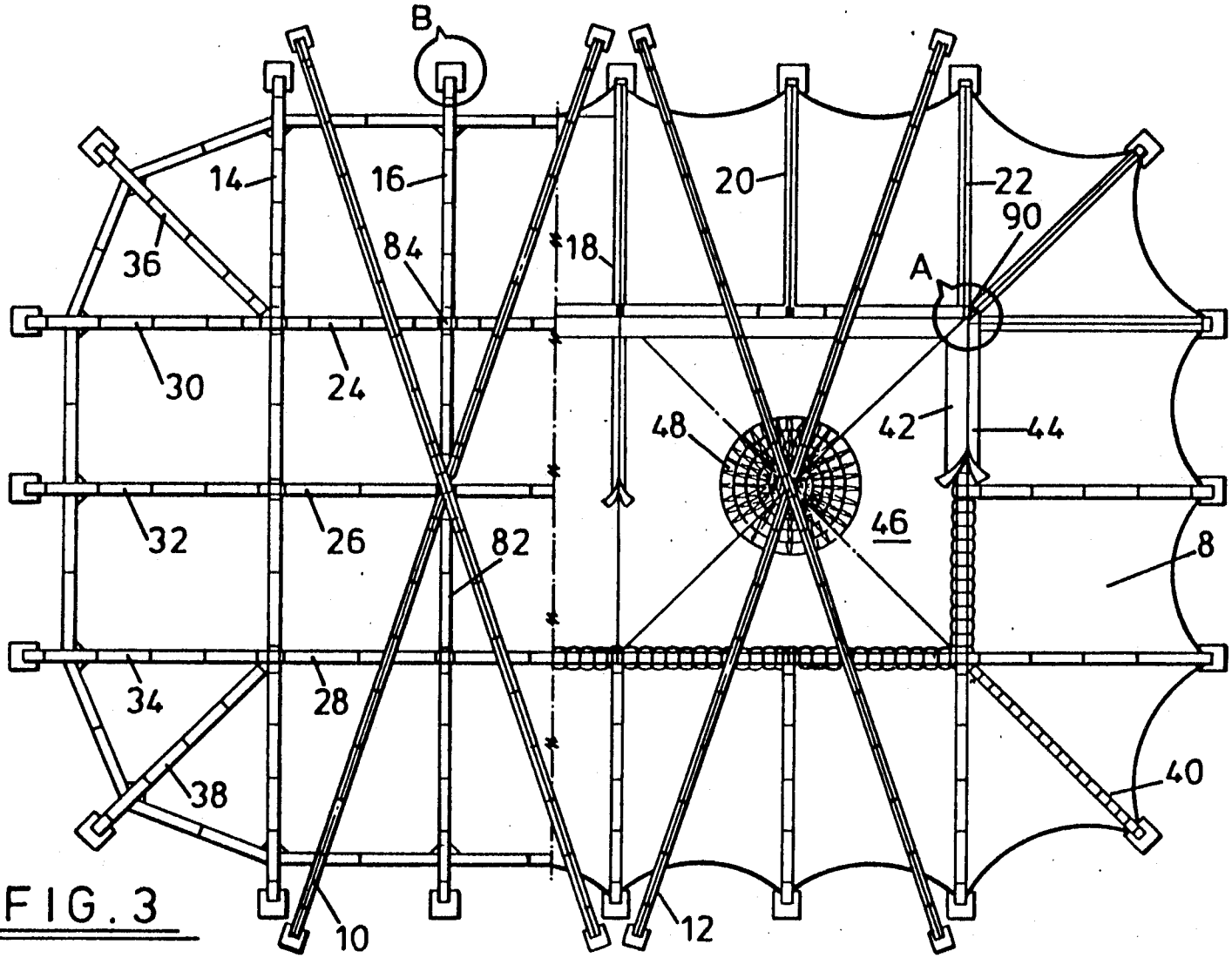
FIG. 3 is a partially cutaway plan view.
Figure 9:
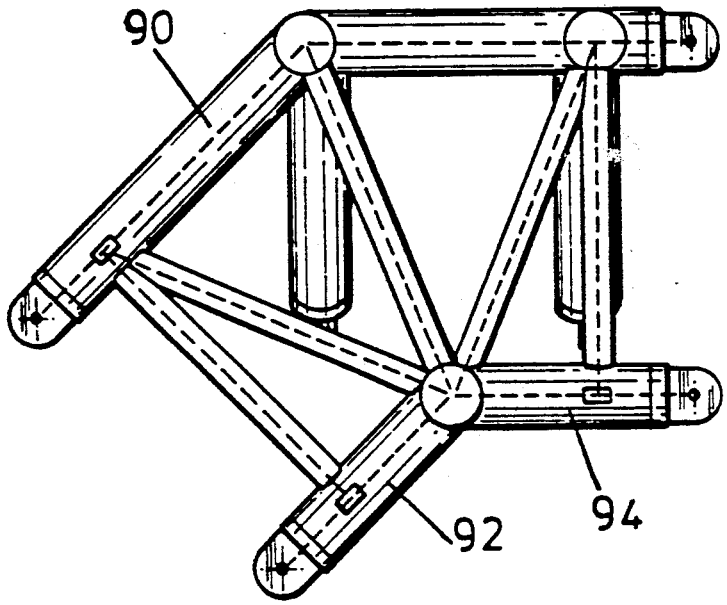
FIGS. 9 and 10 are side and plan views respectively of a corner connector member indicated by circle A in FIG. 3.
Figure 10:
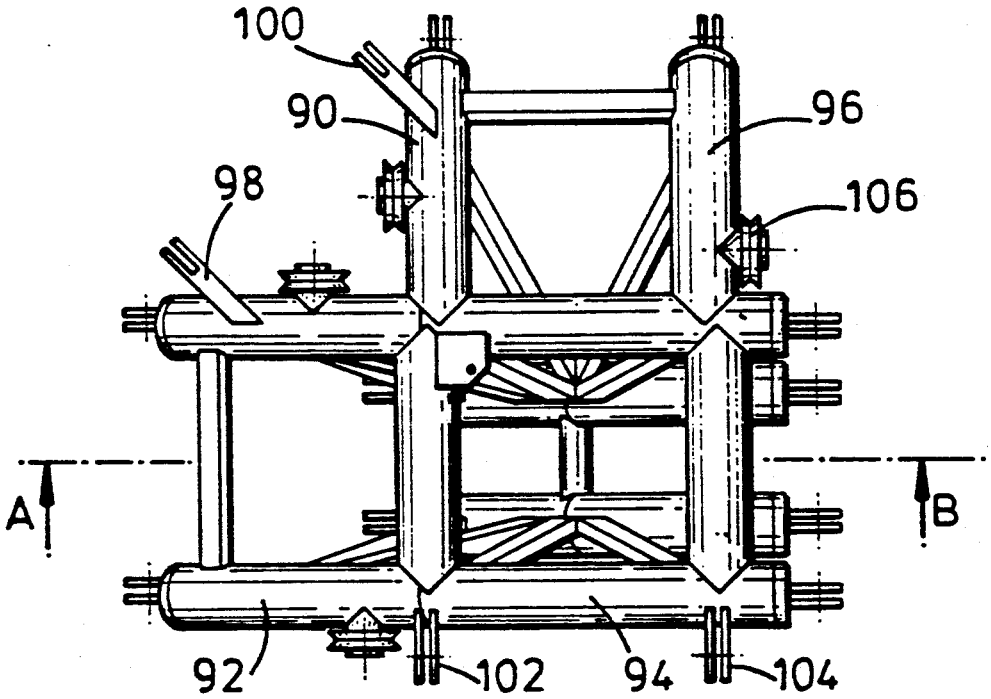

The frame structures are shown in more detail in FIG. 3. The portal frame structure comprises five transversely extending portal frames 14, 16, 18, 20, 22 as shown in part in FIG. 6, which are interconnected by longitudinal members 24, 26, 28 so as to form a roof structure 6 capable of supporting substantial loads of, for example, audio equipment and lighting. Suitable connectors of the general type shown in FIGS. 9 and 10 are provided at cross over points. Each end of the portal frame structure comprises inwardly inclined side members 30, 32, 34 and inclined corner members 36, 38. These members brace the portal frame structure and are of triangular or trapezoidal cross section. The portal frame structure provides an uninterrupted view for spectators, with the absence of internal supporting pillars. The fabric of the weatherproof membrane 8 is shown partially cut away in FIG. 3. The fabric is fixed to the portal frame structure by webbing belts 40 and sealed by means of closing flaps 42, 44 (for example) along edges of adjacent membrane pieces. Alternatively, adjacent pieces may be interconnected by zippers or by sewing a rope into the edge of the adjacent fabric and providing flexible roped edge connectors. Above the flat roof structure 6, the weatherproof membrane is suspended into a substantially conical-shape portion 46, which is provided with a apical portion 48 of plisse fabric (i.e. pleated) so as to allow full ventilation by natural convection.

Figure 4:
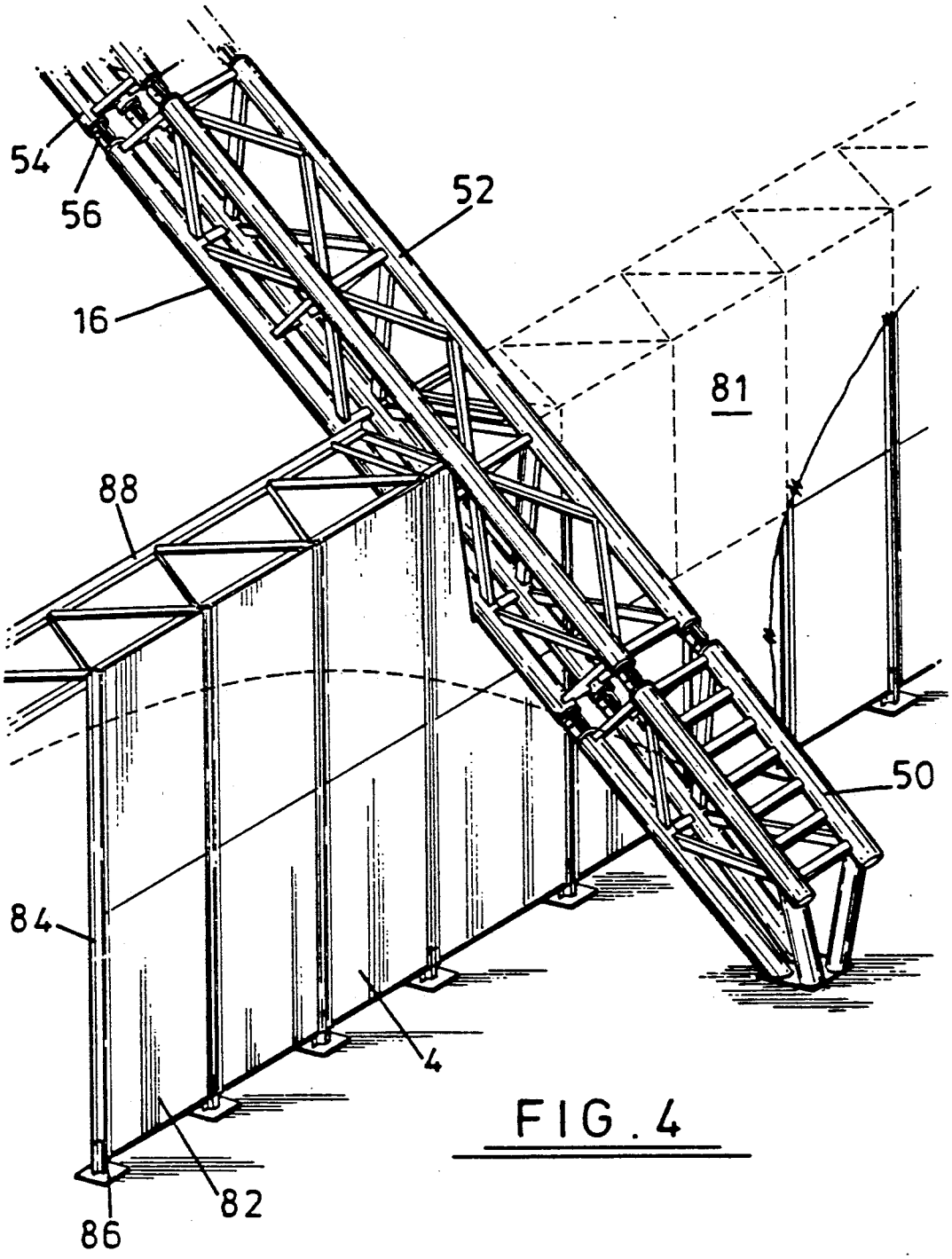
FIG. 4 is a detailed view of the lower end of an inclined side member of the portal frame structure (ground plate omitted) and associated wall structure.
Figure 5:
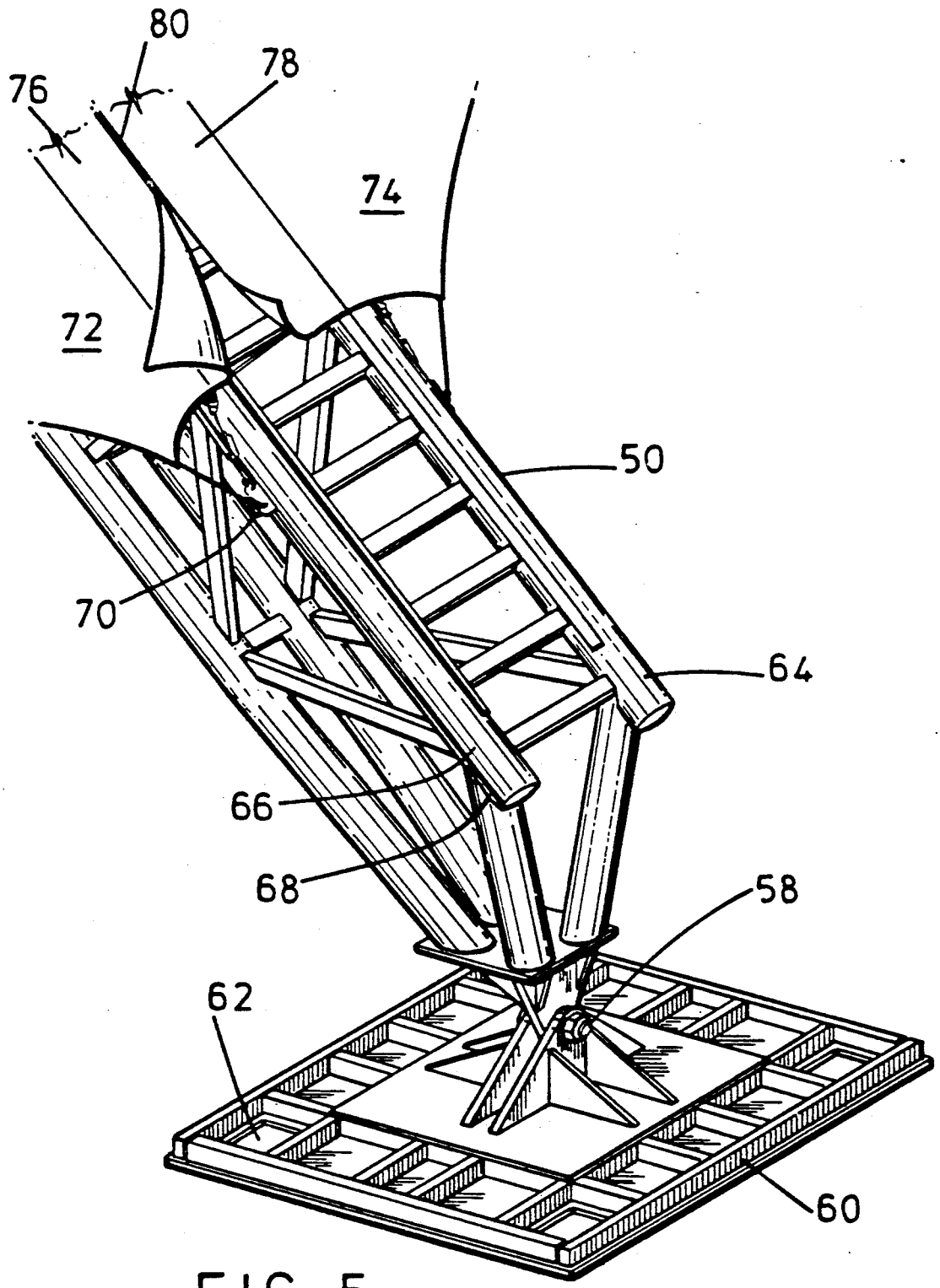
FIG. 5 is a view of the end of the side member and ground plate which is indicated by circle B in FIG. 3.

FIG. 4 shows in more detail the base of portal frame 16, which comprises a foot section 50 connected to a standard trapezoidal-section braced girder 52, which in turn is connected to an identical section 54. The girders are interconnected by means of four pairs of connectors 56 etc. Each connector comprises two fingers which are interdigitated with the corresponding fingers on the adjacent connector before being secured by a bolt (not shown). As shown in FIG. 5 the lower end of the foot girder 50 is moveably connected by means of a bolt 58 to a base plate 60 provided with corner apertures 62 through which steel pegs are driven into the ground. The upper tubular members 64, 66 of the section 50 are provided with slots 68 to accommodate slidable pieces 70 to which the ends of membrane pieces 72, 74 are attached by means of cables and shackle pins. This enables the membrane to be tightened. Adjacent edges 76, 78 of the membrane pieces are joined by means of a zipper 80.

As shown in FIG. 4, the interior wall 81 of the portal frame comprises a series of upright panels 82 etc. slid into channel-section uprights 84 resting on feet 86 and interconnected at an upper end by framework 88.

Figures 6, 7:
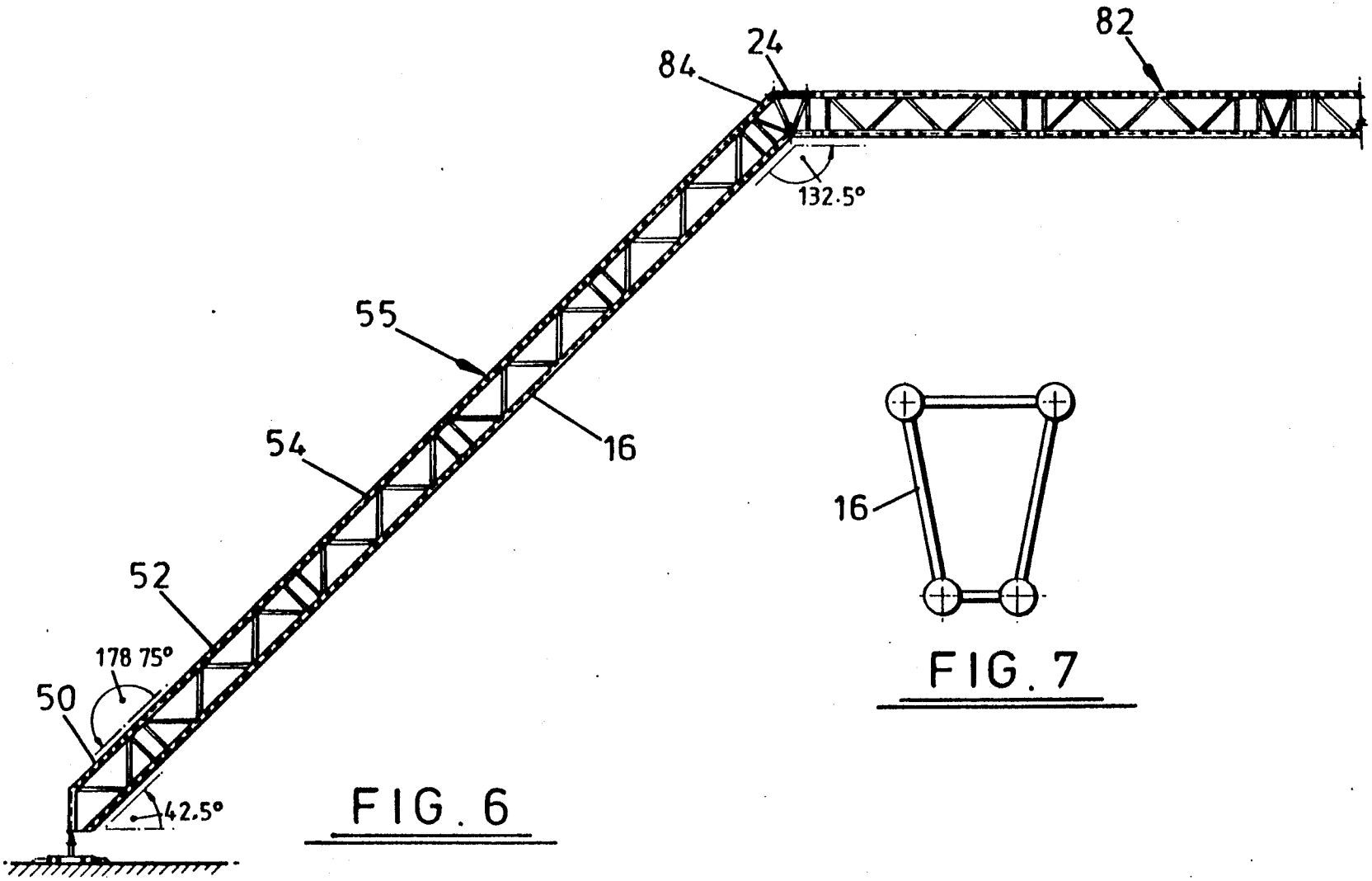
FIG. 6 is a side view of part of the portal frame structure.
FIG. 7 is a typical cross section of the frame members.

FIG. 6 shows in more detail the assembly of part of the portal frame 16 from foot girder 50 and four standard sections 52, 54 etc. which form the inclined side 55 of the portal frame. The roof part 82 of the portal frame is connected to the side members by a connector 84 which also connects the triangular-section (or trapezoidal-section) longitudinal roof member 24.

FIG. 7 shows a typical cross-section of the frame members. Alternatively, some of the frame members may be of triangular cross-section depending on their load bearing requirements.

Figure 8:
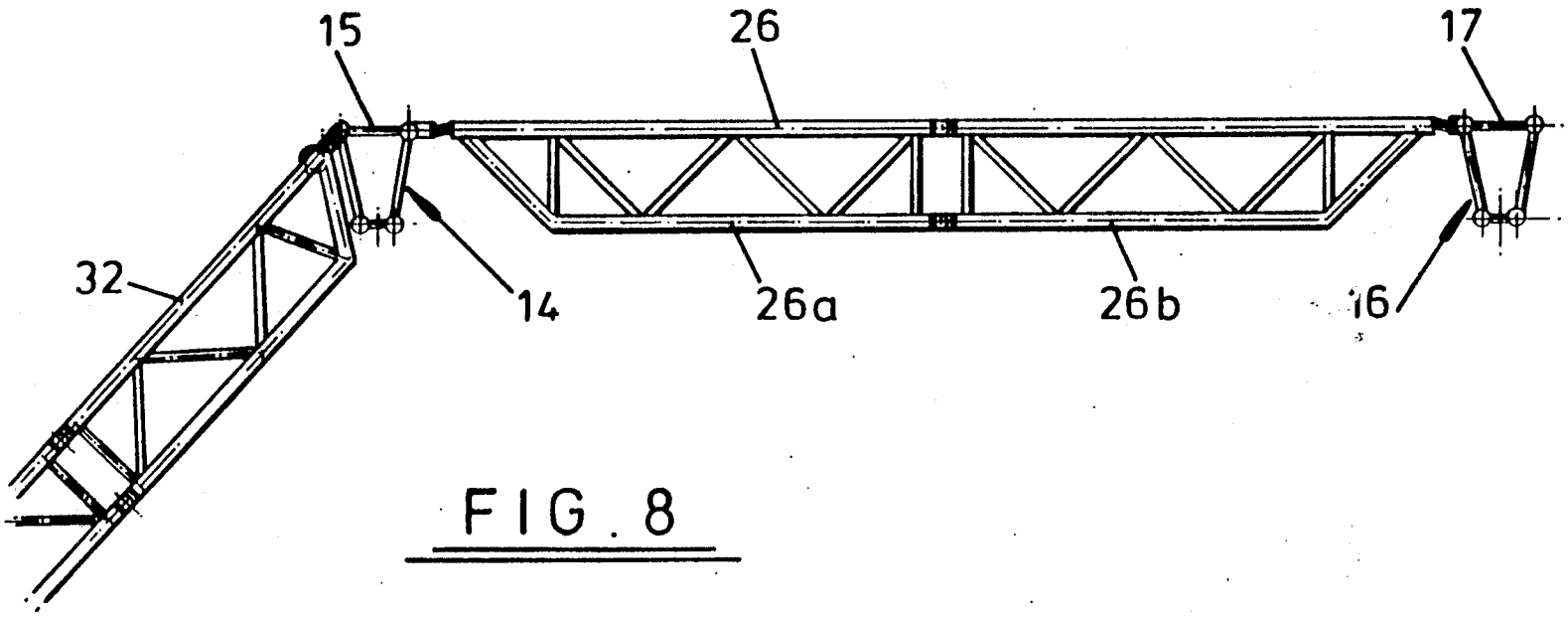
FIG. 8 is a cross section showing longitudinally extending members of the roof structure.

FIG. 8 shows a longitudinal section including inclined side member 32 and longitudinal member 26 (which is made up of interconnected lengths 26*a* and 26*b*). Knee joints 15 and 17, which form part of portal frames 14 and 16 respectively, are shown in cross-section.

FIGS. 9 and 10 show in more detail the construction of a portal frame corner member 90. Inclined trapezoidal-section portion 92 connects to the inclined side member of the portal frame 22, whilst trapezoidal-section portion 94 connects to the horizontal roof portion. In addition, triangular-section portion 96 connects into one of the inclined end members of the portal frame structure, whilst connectors 98, 100 connect an inclined corner member. Connectors 102, 104 connect longitudinal triangular-section roof member 24. Pulleys 106 etc. are provided for tensioning cables associated with the weatherproof membrane.

Figure 11:
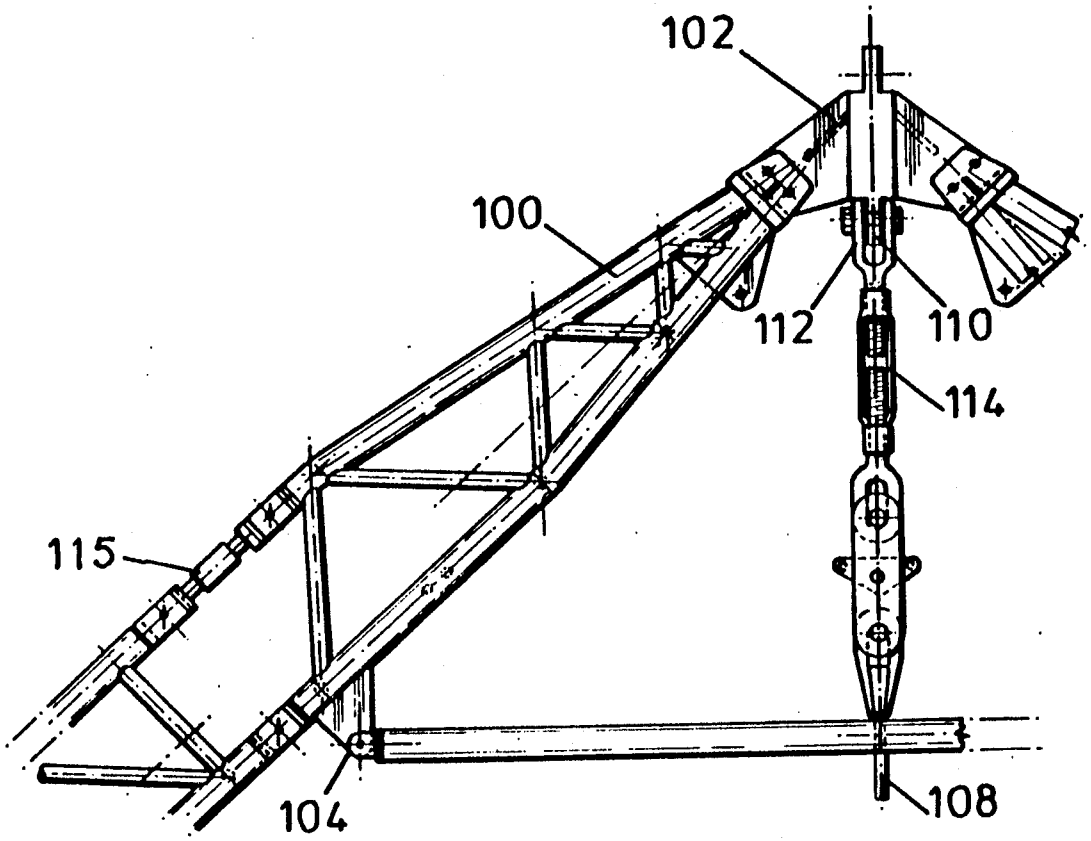
FIG. 11 shows the apex of a pyramidal frame structure.

FIG. 11 shows part of the apex of pyramidal frame 10 or 12, where four triangular section pyramid frame members 100 are interconnected onto apex block 102. A brace member 104 is connected between opposite pyramid frame members. Rigging screw 115 allows the relative angles of the pyramid frame members to be adjusted. Cable 108 which suspends the top of the membrane is hung from eye 110 on the apex block 102 by a shackle 112 and tensioning screw 114.

I claim:

1. A covered arena structure capable of being erected and dismantled, which comprises:

an interior portal frame structure comprising a series of inwardly inclined side members; an interior roof structure around the periphery thereof so as to define a substantially unobstructed arena area;

a weatherproof membrane covering the interior portal frame structure and being draped over the inwardly inclined side members;

an exterior pyramidal frame structure outside the membrane; and suspension means connected between the pyramidal structure and the membrane so as to suspend a portion of the membrane located above the interior roof structure.

2. A structure according to claim 1, wherein the interior roof structure is formed of a grid of interconnected girders.

3. A structure according to claim 1, which further comprises a substantially vertical wall around the base of the interior portal frame structure in the angle between the inclined side members and the ground.

4. A structure according to claim 1, wherein the exterior pyramidal frame structure comprises four members meeting at an apex from which the membrane is suspended.

5. A structure according to claim 1, which comprises at least two exterior pyramidal frame structures spaced along the length of the arena structure and both supporting the weatherproof membrane via respective suspension means.

6. A covered arena structure capable of being erected and dismantled, which comprises:

(a) an interior portal frame structure comprising a series of inwardly inclined side members supporting an interior roof structure supported around the periphery of said roof structure by said inclined side members so as to define a substantially unobstructed arena area, wherein said interior portal frame structure is formed of interconnected sections, wherein said interconnected sections are formed of parallel interbraced metal tubes;

(b) a weatherproof membrane covering the interior portal frame structure and being draped over the inwardly inclined side members;

(c) an exterior pyramidal frame structure outside the membrane, wherein said exterior pyramidal frame structure is formed of interconnected sections, wherein said interconnected sections are formed of parallel interbraced metal tubes;

(d) suspension means connected between the pyramidal structure and the membrane so as to suspend a portion of the membrane located above the interior roof structure.

7. A structure according to claim 6, wherein the interior roof structure is formed of a grid of interconnected girders.

8. A structure according to claim 6, which further comprises a substantially vertical wall around the base of the interior portal frame structure in the angle between the inclined side members and the ground.

9. A structure according to claim 6, wherein the exterior pyramidal frame structure comprises four members meeting at an apex from which the membrane is suspended.

10. A structure according to claim 6, which comprises at least two exterior pyramidal frame structures spaced along the length of the arena structure and both supporting the weatherproof membrane via respective suspension means.

11. A structure according to claim 1 or 6, wherein said weatherproof membrane has an apex, and wherein said apex is suspended from said exterior pyramidal frame structure by said suspension means above said portal frame structure so as to produce a generally pyramidal or conical roof above said portal frame structure.

* * * * *

UNITED STATES PATENT AND TRADEMARK OFFICE
CERTIFICATE OF CORRECTION

PATENT NO. : 5,076,031

DATED : December 31, 1991

INVENTOR(S) : Dennis Michael Hancock

It is certified that error appears in the above-identified patent and that said Letters Patent is hereby corrected as shown below: On the Title page, item [56]

References Cited:

U.S. PATENT DOCUMENTS:

Delete "2,903,238 7/1980 Stromeyer ..... 135/97".

Add -- 3,773,061 11/1973 Berger ..... 135/1R
3,990,194 11/1976 Huddle ..... 52/80

On the Title page, item [30]

FOREIGN PATENT DOCUMENTS:

insert-- 474,172 6/76 Australia ..... 81.3, 81.4
2 832 770 7/80 Germany
2 903 238 2/80 Germany
586,510 7/89 Australia
593,796 2/90 Australia --.

On the Title page, col. 2

Assistant Examiner -- delete "Wyhh" and insert -- Wynn --.

Column 4, line 31, after "structure" insert -- supported --; delete "thereof" and insert -- of said roof structure by

UNITED STATES PATENT AND TRADEMARK OFFICE

CERTIFICATE OF CORRECTION

PATENT NO. : 5,076,031

DATED : December 31, 1991

INVENTOR(S) : Dennis Michael Hancock

It is certified that error appears in the above-identified patent and that said Letters Patent is hereby corrected as shown below:

said inclined side members --.

Signed and Sealed this

Twenty-fifth Day of May, 1993

*Attest:*

Michael K. Kirk

MICHAEL K. KIRK

*Attesting Officer*

*Acting Commissioner of Patents and Trademarks*